United States Patent [19]

Stahlecker

[11] 4,035,871

[45] July 19, 1977

[54] OPENING AND CLEANING APPARATUS FOR AN OPEN END SPINNING UNIT

[75] Inventor: Fritz Stahlecker, Bad Uberkingen, Germany

[73] Assignees: Fritz Stahlecker; Hans Stahlecker, both of Germany

[21] Appl. No.: 600,053

[22] Filed: July 29, 1975

[30] Foreign Application Priority Data

Aug. 22, 1974 Germany ..... 2440224

[51] Int. Cl.[2] ..... D01G 9/00

[52] U.S. Cl. ..... 19/200; 19/96; 19/202

[58] Field of Search ..... 19/88, 89, 105, 202, 19/200, 96; 57/58.95, 58.91

[56] References Cited

U.S. PATENT DOCUMENTS

| | | | |
|---|---|---|---|
| 2,071,438 | 2/1937 | Shorter et al. | 19/89 |
| 2,403,384 | 7/1946 | Locke | 19/105 |
| 3,205,538 | 9/1965 | Miller et al. | 19/105 X |
| 3,828,539 | 8/1974 | Croasdale et al. | 57/58.95 X |
| 3,884,028 | 5/1975 | Stahlecker et al. | 57/58.95 X |
| 3,938,310 | 2/1976 | Didek et al. | 19/105 X |

FOREIGN PATENT DOCUMENTS

| | | | |
|---|---|---|---|
| 1,477,755 | 3/1967 | France | 19/105 |
| 74,205 | 6/1970 | Germany | 19/105 |
| 46-857 | 1/1971 | Japan | 19/105 |
| 791,339 | 2/1958 | United Kingdom | 19/105 |
| 892,295 | 3/1962 | United Kingdom | 19/89 |
| 1,113,025 | 5/1968 | United Kingdom | 19/89 |

*Primary Examiner*—Dorsey Newton
*Attorney, Agent, or Firm*—Craig & Antonelli

[57] ABSTRACT

In order to provide effective cleaning of the opened fibrous material to be supplied to a spinning rotor, the fiber tuft projects into a removal opening opposite the opener roller, thereby permitting the impurities to be beaten out of the fibers, clamped between supply roller and supply table, by the clothing on the opener roller. They then fall directly into the removal opening without having to rebound from a wall.

12 Claims, 4 Drawing Figures

OPENING AND CLEANING APPARATUS FOR AN OPEN END SPINNING UNIT

The present invention relates to an open-end spinning unit containing a supply roller, operating conjointly with a supply table, followed by an opener roller, as well as means for cleaning fibrous material supplied in the form of a sliver, the means having a removal opening.

In a known design (German Published Patent Application No. 1,914,115), the walls of a housing surrounding the opener roller are designed as fibre guide surfaces which become a fibre supply channel leading to a spinning rotor. In this design, the fibre guide surfaces are divided into two sections, with a removal opening for impurities being arranged therebetween and having a removal edge opposite the direction of travel. In the known design, the fibre guide surfaces are intended to deviate the direction of travel in whose area the removal opening is located, thereby causing the impurities, which are more sluggish as a result of their higher mass, to fly out through the removal opening, while the fibres are deviated to the next section of the fibre guide surfaces. It is explained that it is important for the removal opening and the removal edge not to be located immediately adjacent to the point of supply of the fibres or to the point of discharge into the fibre supply channel, but to be separated therefrom by at least a portion of the housing wall, as either removal of the impurities or the quality of the yarn would otherwise be negatively influenced. The known design results in several disadvantages caused, not in the least, through the presence of the removal edge, in whose area the air forms a vortex at the periphery of the opener roller, although a generally laminar airstream would be desirable at this point. As a result of the air vortex, there is a danger of the fibres being bent, curved or otherwise deformed and reaching the spinning rotor through the fibre supply channel in this form.

A further design is also known (German Disclosed Patent Publication No. 2,023,234), in which the impurities are to be spun off into a removal opening by the opener roller and in which the defining wall of the removal opening extends almost tangentially to the opener roller in the direction of travel. This design also contains fibre guide surfaces in front of and behind the removal opening, which support the fibre tuft in front of the removal opening and guide it to the opener roller.

In a further know design (German Disclosed Patent Application No. 2,210,508), an airstream is directed at the opener roller through a cleaning slit for the purpose of permitting the removed impurities to pass through while preventing fibres from being removed.

All of the aforementioned designs utilize the fact that rotational acceleration is imparted to both the opened fibres and the impurities contained therein, whereby the impurities, which have a greater mass, move further toward the outside, permitting them to be spun or wiped off on removal edges, in particular if the direction of travel is then also altered with the aid of an airstream.

In carding, which is in a comparable category, it is known practice (German Published Patent Application No. 1,510,337) to provide a removal opening directly following a supply table, in whose area stripping blades or an air channel formed by partitions are arranged. In this design, the supply table has a guide surface which supports the fibre tuft offered to the card and is directed in the direction of travel. As a result, both the fibres and the impurities are accelerated in the direction of travel and taken along by the card clothing. This design also utilizes the fact that the centrifugal force acting radially on the fibres and the impurities causes the impurities to free themselves from the card clothing and be removed.

However in all of the aforementioned cleaning devices there is a danger that relatively light impurities, in particular, will not free themselves from the area of the clothing after having been accelerated in the direction of travel of the card or the opener roller and are therefore transported on together with the fibrous material. This can affect the effect of the known cleaning devices.

It is the object of the present invention to increase the effect of a cleaning device of the type mentioned at the outset and, in particular, to ensure that even relatively light impurities are dependably removed from the fibrous material. According to the present invention, this object is solved in that the removal opening begins directly behind the supply table and extends over a portion of the circumference of the opener roller and a fibre tuft offered to the opener roller by the supply roller and the supply table projects therein.

In the development according to the present invention, the impurities contained in the sliver, or more precisely in the fibre tuft, are not given any opportunity to be accelerated in the direction of travel of the opener roller, as they are beaten out of the fibre tuft immediately after contacting the opener roller. Even relatively light impurities can be dependably removed. The clothing on the opener roller beats the impurities out in a generally tangential direction, as the clothing strikes the impurities generally with radial surfaces. In a manner which may be considered somewhat amazing, it has been found that, in contrast to the impurities, the fibres are readily taken along by the opener roller in the direction of travel, which is probably caused by the fact that they are still held in the clamping point between supply roller and supply table when they first contact the clothing of the opener roller, so that they tend to cling to the opener roller.

Advantageous embodiments as shown in FIGS. 1 and 4 ensure that the impurities also dependably reach the removal opening even if they are not beaten out of the fibre tuft completely tangentially. The embodiments shown in FIGS. 1 and 4 ensure that there is a largely stabilized airstream in the area of the transition to the fibre guide surface following the removal opening, which cannot result in tangling of the fibres; permit the fibre tuft to be advanced even more dependably to the opener roller, without hindering the beating out of the impurities; ensure that the supply table does not hinder removal of the impurities and prevent the impurities from being spun off laterally.

The above discussed and other objects, features and advantages of the present invention will become more apparent from the following description thereof, when taken in connection with the accompanying drawing, in which FIG. 1 shows a section through a schematically represented embodiment of the invention;

Figure 1:
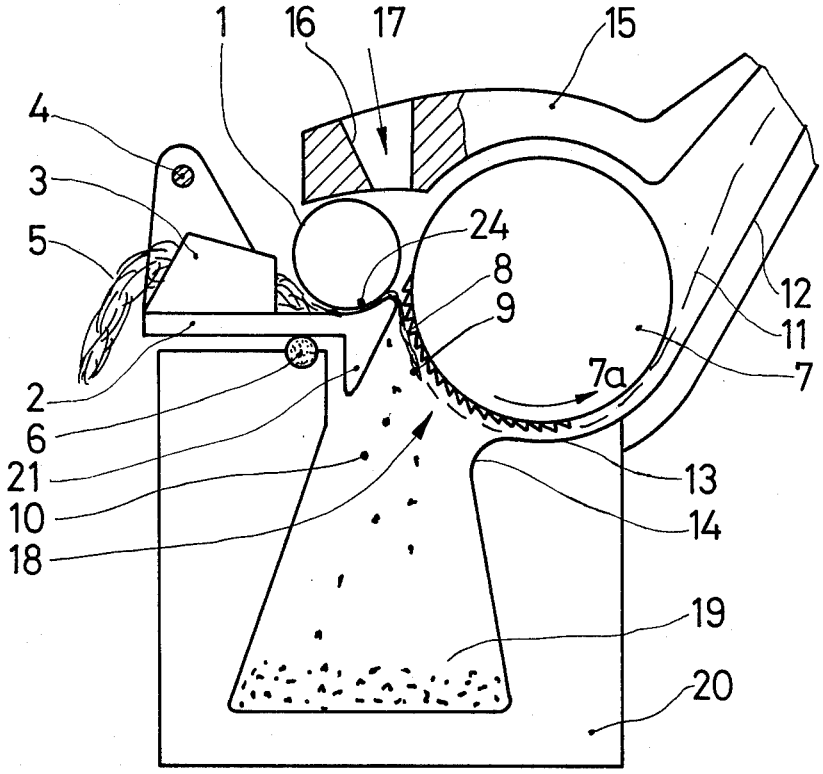

Referring now to the drawings, wherein like reference numerals designate like parts throughout the several views, FIG. 1 is a schematic representation of a supply and opening device containing a supply roller 1 which, operating conjointly with a supply table 2 pressed against it resiliently in an unillustrated manner, offers a sliver 5, supplied by means of a supply funnel 3 which can pivot about an axle 4, to an opener roller 7, whose periphery is covered with clothing, in the form of a fibre tuft 9. Opener roller 7 advances the opened fibres 11 in the direction of arrow 7a to an unillustrated spinning rotor through a fibre supply channel 12. The fibre advance is supported by an airstream 17, which is supplied through a supply opening 16 located above supply roller 1 in a housing 15 covering supply roller 1 and opener roller 7, with the airstream being directed generally tangentially toward opener roller 7. Supply table 2 is sealed off from the housing 20 located therebelow by means of elastic sealing means 6. In order to remove impurities 10 from sliver 5 and to advance only fibres 11 to the greatest extent possible, supply table 2 is followed directly by a removal opening 18, which extends generally one quarter of the circumference of opener roller 7 and leads to a collection chamber 19 in housing 20. The removal edge of supply table 2, which projects relatively far into the gap between supply roller 1 and opener roller 7, is followed by a surface which retracts from the tangential of the opener roller at an angle of about 45°, so that fibre tuft 9 is offered to opener roller 7 without any support whatsoever. As a result of this design, clothing 8 on opener roller 7 beats impurities 10 out of the unsupported fibre tuft, with impurities 10 flying generally tangentially downward into removal opening 18. The fibres, on the other hand, which are first held at the clamping point 24 between supply table 2 and supply roller 1, stick to opener roller 7 and are taken along thereby in its direction of travel. Through this design, the impurities in the fibre tuft can receive virtually no acceleration in the direction of travel of opener roller 7, so that, basically, they can also not be taken along by opener roller 7.

Removal opening 18 is followed by a fibre guide surface 13 of housing 20, which then becomes the fibre supply channel 12. The wall which defines removal opening 18 in the direction of travel of the fibres becomes fibre guide surface 13 with a clearly visible round configuration 14, thereby eliminating the possibility of negative flow influences.

Figure 2:
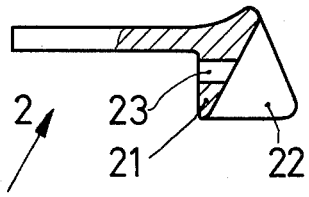
FIG. 2 shows a modified detail of the device according to FIG. 1.
Figure 3:
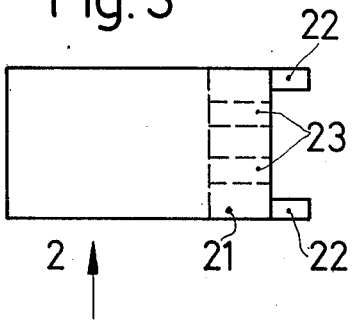
FIG. 3 shows a top view of the detail according to FIG. 2.

FIGS. 2 and 3 show a supply table 2 that is somewhat modified relative to the embodiment according to FIG. 1. In the area of surface 21, which retracts from opener roller 7, there are two supply air openings 23, through which an airstream which presses fibre tuft 9 against clothing 8 of opener roller 7 can be generated. Moreover, this surface 21 has two lateral tabs 22 which surround fibre tuft 9 from the sides and prevent impurities 10 from being able to fly away to the side when beaten by clothing 8.

Figure 4:
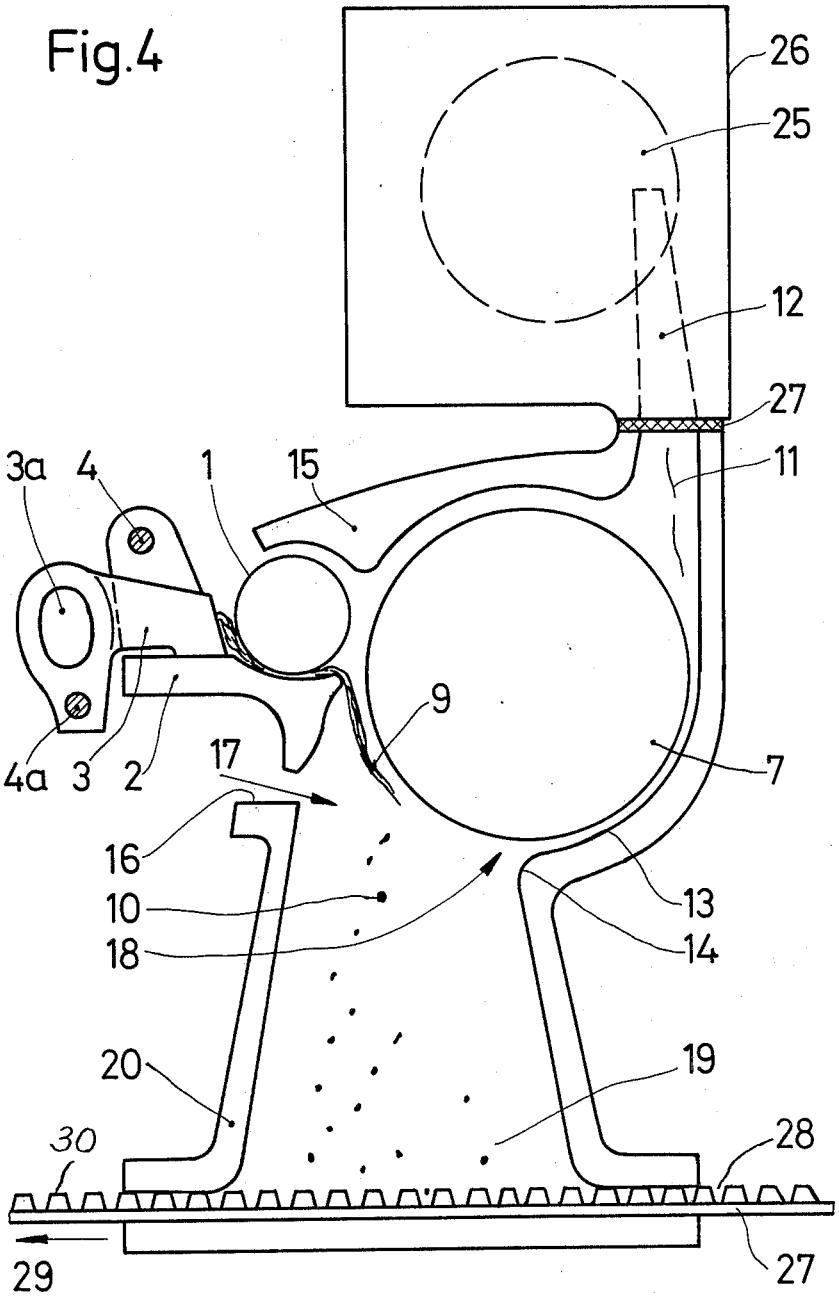
FIG. 4 shows a section through a further schematically represented embodiment of the invention.

The embodiment shown in FIG. 4 is modified slightly relative to the embodiment according to FIG. 1. Opened fibres 11 are advanced to a spinning rotor 25, arranged axially parallel to opener roller 7, through a fibre supply channel in a housing 26. Sealing means 27 are arranged between housing 26 and that portion of fibre supply channel 12 located in housing 15. In this embodiment, supply funnel 3 is designed as a component which is independent of supply table 2, which can pivot about an axle 4, and has a supply opening **3*a* and a swivel axle 4*a***.

In this embodiment, also, removal opening 18 directly follows a supply table 2, which retracts after its removal edge, which projects between supply roller 1 and opener roller 7, so that fibre tuft 9 is entirely free and is not supported. In this embodiment, an air-stream 17 is introduced directly below the supply table, penetrating housing 20 through a supply air opening 16. Removal opening 18 is followed, by means of a clearly visible round configuration, by a fibre guide surface 13, which leads to fibre supply channel 12. The base of collection chamber 19, which follows beneath removal opening 18, is formed by a conveyor belt 30, which has individual pockets 28 or similar means and which moves past the individual spinning units in the longitudinal direction of the spinning machine in the direction of arrow 29.

Obviously, many modifications and variations of the present invention are possible in the light of the above teachings. It should therefore be understood that within the scope of the appended claims, the invention may be practiced otherwise than as specifically described.

Having thus fully disclosed my invention, what I claim is:

1. Opening and cleaning apparatus for an open-end spinning unit comprising:

a fibre supply roller, a supply table in facing relationship to said supply roller, said supply roller and supply table being disposed to define a fibre supply path therebetween and being configured to resiliently clamp said fibre at a clamping section, an opener roller disposed downstream of said supply roller and supply table, said opener roller including clothing for beating impurities out of fibre tufts supplied thereto by said supply roller and supply table at a fibre supply section located downstream of said clamping section in the travel direction of said fibre tufts, said supply table including a removal edge portion at the end of said clamping section closest to said opener roller, said removal edge portion of said supply table being immediately followed by a surface which retracts from said opener roller, a fibre guide surface in facing relationship with a peripheral portion of said opener roller, said fibre guide surface and peripheral portion defining a guide path for guiding fibres into a fibre guide channel arranged downstream of said opener roller, and an impurity removal opening extending from immediately adjacent said removal edge portion to said fibre guide surface, said removal opening having a defining wall which merges in a transition section thereof into said fibre guide surface, said transition section being of rounded configuration to form a converging fibre inlet opening into said guide path at the side of said removal opening opposite the supply table, said removal opening and said supply roller and supply table being geometrically configured and disposed with respect to said opener roller so that the fibre tufts are offered to said opener roller at said supply section supported only at said clamping section, and without any support across the removal opening other than said opener roller, thereby permitting impurities to be beaten out of the fibres by the clothing and to fall freely into the removal opening without rebounding from a wall or other structure.

2. Apparatus according to claim 1, wherein said supply roller, supply table, and opener roller are supported at a housing, said housing defining said removal opening and said fibre guide surface.

3. Apparatus according to claim 2, wherein sealing means are provided to close off a space between the bottom of said supply table and said housing means.

4. Apparatus according to claim 1, in which said removal opening is followed by a collection chamber whose base is designed as conveying means.

5. Apparatus according to claim 1, further comprising a fibre supply channel for guiding cleaned fibres from said opener roller to a spinning rotor of a spinning unit.

6. Apparatus according to claim 5, in which said removal opening extends over approximately one quarter of the circumference of said opener roller.

7. Apparatus according to claim 5, further comprising means for directing an airstream toward said opener roller in the area of said fibre supply section.

8. Apparatus according to claim 7, in which said removal opening extends over approximately one quarter of the circumference of said opener roller.

9. Apparatus according to claim 1, in which said supply table has lateral tabs arranged next to said removal edge portion.

10. Apparatus according to claim 9, wherein supply air openings are provided in said supply table intermediate said lateral tabs.

11. Apparatus according to claim 1, further comprising a supply air opening directed generally tangentially toward a gap between said supply roller and said opener roller, the supply air opening being arranged above said supply roller.

12. Apparatus according to claim 11, in which said supply table has lateral tabs arranged next to said removal egde portion.

* * * * *